US005603071A

United States Patent [19]

Kitagawa et al.

[11] Patent Number: 5,603,071

[45] Date of Patent: Feb. 11, 1997

[54] METHOD OF PREPARING CEMENTED CARBIDE OR CERMET ALLOY

[75] Inventors: Nobuyuki Kitagawa; Toshio Nomura, both of Hyogo, Japan

[73] Assignee: Sumitomo Electric Industries, Ltd., Osaka, Japan

[21] Appl. No.: 416,485

[22] Filed: Apr. 4, 1995

Related U.S. Application Data

[63] Continuation of Ser. No. 689,889, filed as PCT/JP90/01179 Sep. 12, 1990 published as WO91/04245 Apr. 4, 1991, abandoned.

[30] Foreign Application Priority Data

Sep. 14, 1989 [JP] Japan ..... 1-238849

[51] Int. Cl.[6] ..... B22F 3/10

[52] U.S. Cl. ..... 419/15; 264/63; 419/10; 419/14; 419/36; 419/37; 419/53

[58] Field of Search ..... 264/63, 344, 101; 419/10, 14, 15, 36, 37, 53

[56] References Cited

U.S. PATENT DOCUMENTS

| | | | |
|---|---|---|---|
| 2,939,199 | 6/1960 | Strivens | 264/63 |
| 3,871,630 | 3/1975 | Wanetzky | 266/20 |
| 4,305,756 | 12/1981 | Wiech, Jr. . | |
| 4,836,980 | 6/1989 | Kashiwadani et al. . | |
| 5,028,367 | 7/1991 | Wei et al. | 264/344 |

FOREIGN PATENT DOCUMENTS

| | | |
|---|---|---|
| 41-21321 | 12/1966 | Japan . |
| 51-126308 | 11/1976 | Japan . |
| 62-33282 | 7/1987 | Japan . |
| 2-11703 | 1/1990 | Japan . |
| 2-70004 | 3/1990 | Japan . |

*Primary Examiner*—James Derrington
*Attorney, Agent, or Firm*—W. G. Fasse; W. F. Fasse

[57] ABSTRACT

Disclosed is a method of preparing a cemented carbide or a cermet alloy by mixing and kneading cemented carbide powder or cermet alloy powder with an organic binder, shaping this mixed powder into a prescribed configuration by an injection molding method and thereafter removing the organic binder from this compact and sintering the same, in order to obtain a dense alloy. Removal of the organic binder is performed in a first step in an inert gas atmosphere as a first removal step, and then continued in a second step in a vacuum of not more than 1 Torr. In the first removal step, the pressure is held in excess of the atmospheric pressure, to prevent the formation of imperfections in the compact. After continuous pores are formed in the interior of the compact, the atmosphere pressure is brought close to a vacuum, thereby facilitating the evaporation of gas from the surface and desorption of gas generated in the interior of the compact.

2 Claims, No Drawings

METHOD OF PREPARING CEMENTED CARBIDE OR CERMET ALLOY

CROSS-REFERENCE TO RELATED APPLICATION

This application is a CONTINUATION of application Ser. No. 07/689,889, filed as PCT/JP90/01179 on Sep. 12, 1990, published as WO91/04245 Apr. 4, 1991 now abandoned.

FIELD OF THE INVENTION

The present invention relates to a method of preparing a cemented carbide or a cermet alloy, and more particularly, it relates to a method of preparing a cemented carbide or a cermet alloy by shaping cemented carbide powder or cermet alloy powder into a prescribed configuration by injection molding and then removing an organic binder and sintering the compact.

BACKGROUND INFORMATION

A cemented carbide and a cermet alloy are materials having high melting points. In order to obtain a cemented carbide sintered compact or a cermet alloy sintered compact, a powder metallurgy method of press-molding or CIP-molding (cold isostatic pressing) a powder raw material and thereafter sintering the same, have generally been employed. In the known methods, however, manufacturable configurations are significantly restricted. In order to obtain a complicated final configuration, it is necessary to grind the sintered compact with a diamond grindstone after sintering, leading to an extremely high cost, due to the hardness of the sintered material.

A technique of molding plastic by an injection molding method is also known. Japanese Patent Publication No. 62-33282 discloses a method of kneading metal powder or ceramics powder with an organic binder and shaping the same into an article having a complicated configuration, by injection molding.

When such a powder injection molding technique is applied to a cemented carbide or a cermet alloy, however, the following problems occur. Cemented carbide powder or cermet alloy powder is a fine powder having a particle diameter of about 1 μm. Further, such an alloy has a large gravity. In addition, the tolerance for a carbon concentration in the alloy is small. Due to such material properties of the cemented carbide or the cermet alloy, deformations and imperfections are easily caused during the debinder processing for removal of the organic binder. Besides, it is impossible to obtain an alloy of good quality, due to an influence exerted by residual carbon which is caused by decomposition of the organic binder. In order to avoid such problems, it is necessary to perform the binder removal processing for an extremely long time. Due to the aforementioned problems, an injection molding technique for a cemented carbide and a cermet alloy has not yet been substantially put into practice.

SUMMARY OF THE INVENTION

It is an object of the present invention to provide a method which can obtain a cemented carbide or a cermet alloy of high quality by efficiently shaping cemented carbide powder or cermet alloy powder by an injection molding method, and through a subsequent binder removal processing and a sintering processing.

Another object of the present invention is to provide a method which causes no deformation nor any imperfections of a compact during the binder removal processing.

Still another object of the present invention is to provide a method which can remove the binder in a short time.

The method of the invention is characterized by the following steps:

(a) mixing and kneading a cemented carbide powder or cermet alloy powder with an organic binder to provide a powder binder mixture sufficiently viscous for injection molding, wherein said organic binder contains a first binder component having a first lower removal temperature and a second binder component having a second higher removal temperature, said first binder component comprising a first plurality i of first different types a1, a2, . . . , ai of binders, wherein a1, a2, . . . , ai represent ratios of respective first binder types of said low-temperature removal binder component, said second binder component comprising a second plurality j of second different types b1, b2, . . . , ji of binders, wherein b1, b2, . . . , bj represent ratios of respective second binder types of said high temperature removal binder component so that $\Sigma ai+\Sigma bj=1$; wherein xT1, xT2, . . . , xTi represent loss rates of a single respective low-temperature removal binder type at a certain transition temperature T in inert gas atmospheric pressure heating loss tests (TG); wherein yT1, yT2, . . . , yTj represent loss rates of a single respective high temperature removal binder type at said certain transition temperature T in said inert gas atmospheric pressure heating loss tests (TG); and wherein compositions of respective binder types contained in said organic binder are selected to satisfy the following conditions:

$$\Sigma(bj\times yTj)\leqq 0.05$$

and $$\Sigma bj\geqq 01$$

at said transition temperature T for which $$\Sigma(ai\times xTi)=0.3,$$

wherein said transition temperature T for transition from said first removal step to said second removal step is selected to satisfy the following conditions:

$$\Sigma(ai\times xTi)>0.3$$

and $$\Sigma\{bj\times(1-yTj)\}>0.05,$$

(b) injection molding said powder binder mixture to form a green compact having an injection molded configuration, (c) removing said organic binder from said compact in a first and in a second binder removal step, (d) said first binder removal step comprising heating said green compact in a furnace to said first lower removal temperature in an atmosphere of one of $N_2$ and Ar maintained at a sufficient flow rate within the range of 0.1 liter/min to 3 liter/min and at a pressure within the range of at least 600 Torr to atmospheric pressure of 760 Torr for preventing cracking and blistering of said green compact while removing at least a portion of said organic binder, e) establishing said first lower removal temperature by raising a temperature in said furnace at a rate within the range of 4° C./hour to 10° C./hour until said first lower removal temperature is reached within the range of 350° C. to 450° C., (f) said second binder removal step comprising exposing said compact to a vacuum of 0.2 Torr to 0.5 Torr in said furnace and raising said first lower removal temperature to said second higher removal temperature at a rate of about 50° C./hour until 700° C. is reached as said second higher removal temperature for substantially removing any remainder of said organic binder, (g) maintaining said second removal temperature of 700° C. for about one hour, so that said first binder removal step continues into said second binder removal step, and whereby powder particles in said green compact are deoxidized for an initial bonding of said powder particles to each other to maintain a dimensional stability of said green compact prior to sintering, and (h) sintering said compact by evacuating said furnace to a vacuum of 0.05 Torr, raising said second higher removal temperature in said furnace at a rate of 200° C./hour to a sintering temperature within the range of 1350° C. to 1400° C., maintaining said sintering temperature for at least one hour, and cooling to room temperature.

More specifically, the present invention is characterized in that the removal of the organic binder is first performed in an inert gas atmosphere as a first removal step, and then performed in a vacuum of not more than 1 Torr as a second removal step directly following the first removal step.

According to one aspect of the present invention, the organic binder contains a plurality of types of binders, which are divided into a group removable under a low temperature and a group removable under a high temperature. Compositions of the respective binders contained in the organic binder are selected to satisfy such a condition that the loss rate of the high-temperature removable group is within 5% when the low-temperature removable group is lost by 30% of the whole in an inert gas atmospheric pressure heating loss test (TG) for only the organic binder. Preferably, the rate of the binder belonging to the low-temperature removable group with respect to the overall organic binder is set to be at least 30% and not more than 90%. All percentages are given by weight.

According to another aspect of the present invention, a temperature for transition from the first removal step to the second removal step is selected to satisfy the following condition: The condition is such that the amount of removal of the binder belonging to the low-temperature removable group is at least 30% with respect to the overall organic binder, while the residual rate of the binder belonging to the high-temperature removable group is at least 5% with respect to the overall organic binder. A binder for serving as the main component of the low-temperature removable group is preferably prepared of wax having hydrophilic polar groups, with a melting point of not more than 80° C.

After the organic binder is removed from the compact by the aforementioned method, sintering may be performed as a continuation of the initial binder removal. Alternatively, the compact may be cooled once after the organic binder has been removed and prior to sintering.

An injection-molded compact is formed of powder and a binder, substantially with no voids. When the compact is subjected to a rising temperature in this state, the binder first escapes by expansion of the binder, and then binder removal progresses due to evaporation from the surface. When the binder removal has progressed so that 30% of the binder has been removed, pores communicating with the surface of the compact are formed in the interior of the compact. Gas generated in the interior of the compact is removed through these pores, to further promote the binder removal. However, if the gas is generated in the interior of the compact while less than 30% of the binder have been removed, the compact tends to crack or blister. In order to prevent such cracking or blistering of the compact, it is necessary to suppress the generation of the gas in the interior of the compact by a programming rate that raises the temperature within the low level. Therefore, a long time is required for the binder removal. Wax serving as a plasticizer and high polymer resin serving as a binder are required as binders. Since wax evaporates at a low temperature with no decomposition, it is possible to relatively easily perform the binder removal. On the other hand, high polymer resin is apt to cause imperfections in the compact in an initial state of the binder removal, since the same generates a large quantity of gas by decomposition.

The inventors have noted the aforementioned points, to achieve the present invention. More specifically, a high polymer resin is selected which will not start to decompose even if the temperature reaches such a level that at least 30% of the whole wax content is removed. This type of high polymer resin is mixed with the wax. In an initial state of the binder removal, the removal of at least 30% is facilitated by evaporation of the wax alone, to form continuous pores in the interior of the compact. After the pores are formed, decomposition of the high polymer resin begins.

Hoechst wax, carnauba wax, montan wax, ozokerite wax, auriculine wax, candelilla wax, beeswax, microcrystalline wax and the like can be cited as major wax materials of the low-temperature removal group. Low density polyethylene, low molecular weight polyethylene, ethylene-vinyl acetate, polypropylene, acrylic resin and the like can be cited as binders of the high-temperature removal group.

In the initial state of the binder removal, the pressure is maintained in excess of the normal atmospheric pressure, thereby preventing the compact from developing imperfections. After continuous pores are formed in the interior of the compact, the pressure is decompressed, or a reduced pressure state close to a vacuum is established, thereby facilitating the evaporation of gas from the surface and desorption of gas generated in the interior of the compact.

The strength of the present injection-molded compact is noteworthy. When the high molecular resin serving as a bonding agent is removed, the bonding strength between the powder particles is substantially reduced, such that a cemented carbide etc. having high specific gravity inevitably collapses. In order to prevent this, it is necessary to attain the required strength by bonding powder materials for forming the alloy. However, since the surfaces of the alloy powder materials are covered with thin oxide films, bonding is hardly caused by diffusion. The inventors have found that, when removal of the binder is performed in a vacuum state, the surfaces of the alloy powder materials are deoxidized by ambient carbon, whereby the required bonding strength is attained between the alloy powder particles. Thus, according to the present invention, binder removal in the vacuum state is facilitated thereby bonding the powder particles with each other. When the powder particles are bonded with each other, the compact will not collapse until the binder removal is terminated. In a preferred embodiment of the present invention, the binder removal is performed in two stages including a first removal step and a second removal step. The first removal step is carried out under normal atmospheric pressure or a slightly reduced pressure of at least 600 Torr, and the second removal step is carried out under a vacuum. In transition from the first removal step to the second removal step, the bonding agent or binder must be left to an extent of at least 5%. If the residual amount of the bonding agent is less than 5%, the compact will collapse before the required bonding strength is attained between the powder particles.

The atmosphere for the binder removal will now be described. The first removal step is preferably carried out in an atmosphere of an inert gas such as $N_2$ or Ar. If the removal is performed in an oxidizing atmosphere such as air, surface oxidation of Co, Ni and the like inevitably progresses during the binder removal. If such surface oxidized layers are present, the bonding strength is inevitably lowered during the second removal step. Further, since oxidation of only a portion exposed to the ambient atmosphere progresses as the binder removal proceeds, the carbon concentration in the alloy becomes non-uniform and a liquid phase may appear during sintering, to significantly reduce the dimensional accuracy of the compact. It is possible to attain a reduction of the oxide films on the surfaces of the alloy powder materials, by carrying out the second removal step not in a vacuum but in an $H_2$ atmosphere. If the binder removal is performed in an $H_2$ atmosphere, however, a reaction is simultaneously caused so that carbide C, which is a hard phase forming component of the cemented carbide or the cermet alloy, reacts with hydrogen to form $CH_4$. Thus, the carbon content of the alloy is reduced.

The types of wax will now be described. The surface of cemented carbide powder or cermet alloy powder is hydrophilic. On the other hand, wax such as n-paraffin is hydrophobic. Therefore, the wettability between the wax such as n-paraffin and the cemented carbide powder or cermet alloy powder is inferior. therefore, in order to attain a viscosity which is required for injection molding, it is necessary to use a larger amount of wax. The inventors have studied various wax materials, to find that the amount of the binder can be reduced by employing a certain type of natural wax having hydrophilic polar groups. When the compact is taken out from a metal mold following an injection molding step, the compact breaks easily since wax is friable. In order to prevent such breakage, it is preferable to use wax having at least a melting point of not more than 80° C. So far as the wax has hydrophilic polar groups with a melting point of not more than 80° C., its effect remains unchanged whether the same is a synthetic or natural wax. While stearic acid or the like may be employed as a lubricant, the effect of the present invention remains unchanged even if such a minor additive is employed.

DETAILED EXAMPLE EMBODIMENTS AND THE BEST MODE FOR CARRYING OUT THE INVENTION

Example 1

80% of WC powder having a particle diameter of 2 to 4 μm, 10% of TiC powder having a particle diameter of 1 to 2 μm, and 10% of Co powder having a particle diameter of 2 to 4 μm were mixed in a wet ball mill for 3 hours, and dried. 6.0% of beeswax and 1.0% of low molecular weight polyethylene were added to 100% of this mixed powder, and these were kneaded at 120° C. for 30 minutes. Then, this raw material mixture was cooled and solidified and thereafter pulverized, to prepare raw material particles of 0.5 to 2.0 mm in particle diameter. Then, injection molding was performed with a mold (20×20×6 mm) having the configuration of a throw-away tip for a cutting tool, to prepare a compact. The compact was placed into a furnace, and the interior of the furnace was held at 1 atm. in an Ar atmosphere. The temperature in the furnace was raised to 425° C. at a programming rate of 8° C./h. under a condition of an Ar flow rate of 3 l/min., to perform the binder removal. Then the temperature in the furnace was raised to 700° C. at a programming rate of 50° C./h. in a state maintaining the interior of the furnace at not more than 0.5 Torr with a vacuum pump. The furnace was held at the 700° C. temperature for one hour, and thereafter cooled, whereby the binder removal process was terminated. Then, the interior of the furnace was brought into a vacuum state of 0.05 Torr and the temperature was raised to 1400° C. at the rate of 200° C./h. The furnace was held at the temperature of 1400° C. for one hour, and thereafter cooled. The as-formed sintered body had absolutely no imperfection, and was excellent with regard to the alloy characteristics. A heating loss test for the binders used in this Example was carried out, whereby 95% of the beeswax was lost before reaching 425° C. under conditions of $N_2$ and 1 atm. On the other hand, the loss of the low molecular weight polyethylene was 13% at 425° C.

Example 2

90% of WC powder having a particle diameter of 0.5 to 2 μm and 10% of Co powder having a particle diameter of 2 to 4 μm were mixed in a wet ball mill for 20 hours, and dried. 5.5% of carnauba wax and 1.0% of low molecular weight polypropylene were added to 100% of this mixed powder, and kneaded at 140° C. for 30 minutes. Then, this raw material mixture was cooled and solidified and thereafter pulverized, to prepare raw material particles of about 0.5 to 2.0 mm in particle diameter. Then, injection molding was performed in a mold (20×20×6 mm) having the configuration of a throw-away cutting tool tip. This compact was placed into a furnace. The interior of the furnace was under an Ar atmosphere of 1 atm., and its temperature was raised to 430° C. at a programming rate of 10° C./h. under a condition of a flow rate of 3 l/min., to perform an initial binder removal. Then, the temperature was raised to 700° C. at a programming rate of 50° C./h. while maintaining the interior of the furnace at not more than 0.2 Torr with a vacuum pump. The furnace was held at the 700° C. temperature for one hour, whereupon the binder removal was terminated. Thereafter the temperature in the furnace was raised to 1350° C. at 200° C./h. in a vacuum of 0.05 Torr. The furnace was held at the 350° C. temperature for one hour and then cooled. The as-formed sintered body had absolutely no imperfections, and had excellent alloy characteristics. A heating loss test was performed on the binders employed in this Example, whereby 92% of the carnauba wax was lost before reaching 430° C. under conditions of $N_2$ and 1 atm. On the other hand, 8% of the low molecular weight polypropylene was lost at 430° C.

Example 3

88% of WC powder having a particle diameter of 0.1 to 1 μm, 6% of Co powder having a particle diameter of 2 to 4 μm and 6% of Ni powder having a particle diameter of 2 to 4 μm were mixed in a wet ball mill for 25 hours, and dried. 0.5% of beeswax, 4.5% of n-paraffin, 0.2% of stearic acid, 0.5% of ethylene-vinyl acetate and 1.0% of low molecular weight polyethylene were added to 100% of this mixed powder, and kneaded at 120° C. for 30 minutes. Then this raw material mixture was cooled and solidified and thereafter pulverized, to prepare raw material particles of about 0.5 to 2.0 mm in particle diameter. Then, an injection molding was performed with a mold (20×20×6 mm) having the configuration of a throw-away cutting tool tip. This compact was placed into a furnace. The interior of the furnace was set in an $N_2$ atmosphere of 1 atm., and its temperature was raised to 380° C. at a programming rate of 13° C./h. under a condition of a flow rate of 2 l/min., to perform an initial binder removal. Then, the temperature was raised to 700° C. at a programming rate of 50° C./h. while maintaining the interior of the furnace at not more than 0.5 Torr with a vacuum pump. The furnace was held at the temperature of 700° C. for one hour and then cooled. Thus, the binder removal was terminated. Then, the interior of the furnace was evacuated to a vacuum of 0.05 Torr, and its temperature was raised to 1350° C. at 200° C./h. The temperature of 1350° C. was maintained for one hour and then cooled. The as-formed sintered body had absolutely no imperfections and had excellent alloy characteristics. A heating loss test was performed on the binders employed in this Example, whereby 60% of the beeswax and 100% of the n-paraffin were lost before reaching 380° C. under conditions of $N_2$ and 1 atm. On the other hand, the loss of the low molecular weight polyethylene was 7.0% and loss of the ethylene-vinyl acetate was 10% at 380° C.

Example 4

88% of WC powder having a particle diameter of 1 to 2 μm and 12% of Co powder were mixed in a wet ball mill for 15 hours, and dried. 5.5% of montan wax and 0.8% of low density polyethylene were added to 100% of this mixed powder, and kneaded at 120° C. for 3 hours. Then, this raw material mixture was cooled and solidified and thereafter pulverized, to prepare raw material particles of about 0.5 to 2.0 mm in particle diameter. Then an injection molding was performed with a mold (20×20×6 mm) having the configuration of a throw-away cutting tool tip. This compact was placed into a furnace. The interior of the furnace was set in an Ar atmosphere of 1 atm., and its temperature was raised to 350° C. at a programming rate of 10° C./h., while maintaining a flow rate of 3 l/min., to perform an initial binder removal. Then, the temperature was raised to 650° C. at a programming rate of 50° C./h. while maintaining the interior of the furnace at not more than 0.5 Torr with a vacuum pump. Then the furnace was held at the 650° C. temperature for one hour and then cooled to terminate the binder removal. Then, the interior of the furnace was evacuated to 0.05 Torr, the temperature was raised to 1400° C. at 200° C./h. The furnace was held at the 1400° C. temperature for one hour and then cooled. The as-formed sintered body had absolutely no imperfections and it had excellent alloy characteristics. A heating loss test was performed on the binders employed in this Example, whereby the loss of the montan wax was 93% before reaching 350° C. under conditions of $N_2$ and 1 atm., while the loss of the low density polyethylene was 0% at 350° C.

Example 5

Cermet powder (50% of TiCN, 10% of TaC, 12% of $Mo_2C$, 13% of WC, 5% of Ni and 10% of Co) having a particle diameter of 0.5 to 1 μm was mixed in a wet ball mill for 10 hours, and dried. 7.8% of montan wax, 2.7% of n-paraffin, 2.7% of low density polyethylene and 0.3% of stearic acid were added to 100% of this mixed powder, and kneaded at 120° C. for 3 hours. Then, this raw material mixture was cooled and solidified and thereafter pulverized, to prepare raw material particles of about 0.5 to 2.0 mm in particle diameter. Then the raw material was injection molded into a mold having a ball end mill configuration of 10 mm in diameter, to obtain a compact. This compact was placed into a furnace. The interior of the furnace was set in an Ar atmosphere of 1 atm., and its temperature was raised to 350° C. at a programming rate of 10° C./h. under a condition of a flow rate of 3 l/min., to perform an initial binder removal. Then, the temperature was raised to 650° C. at a programming rate of 50° C./h. while maintaining the interior of the furnace at not more than 0.5 Torr with a vacuum pump. The furnace was held at the 650° C. temperature for one hour and then cooled to terminate the binder removal. Then, the interior of the furnace was evacuated to a vacuum of 0.05 Torr and the temperature was raised to 1400° C. at 200° C./h. The furnace was held for one hour at 1400° C. and then cooled. Thereafter, a HIP (hot isostatic pressing) was performed at 1350° C. The as-formed sintered body had absolutely no imperfections and had excellent alloy characteristics. A heating loss test was performed on the binders employed in this Example, whereby the loss of the montan wax was 93% under conditions of $N_2$ and 1 atm. before reaching 350° C. and the loss of the n-paraffin was 100% and the loss of the low density polypropylene was 0% at 350° C.

Example 6

A plurality of raw material particle compacts were prepared under the same conditions as those in Example 1. With respect to these compacts, the programming rate in the first removal step and the transition temperature to the second removal step were changed, to examine the states achieved after the binder removal. Table 2 shows the results. Table 1 shows the results of heating loss tests of beeswax and low molecular weight polyethylene (PE). It is clear from the results of Tables 1 and 2, that excellent states are attained by the binder removal according to the present method and the time durations for the binder removal can be shortened.

TABLE 1

| | Heating Loss Rate ($N_2$ 1 atm, Temperature Rising at 10° C./min.) | | | | | | | |
|---|---|---|---|---|---|---|---|---|
| | T | | | | | | | |
| | 250° C. | 300° C. | 350° C. | 375° C. | 400° C. | 425° C. | 450° C. | 475° C. |
| Beeswax (xT) | 0.03 | 0.12 | 0.32 | 0.50 | 0.74 | 0.95 | 0.99 | 1.00 |
| Low Molecular Weight PE (yT) | 0.01 | 0.03 | 0.05 | 0.07 | 0.09 | 0.13 | 0.30 | 0.85 |

TABLE 2

Test Result for Different Transition Temperatures to the Second Step

| Test No. | Transition Temperature to 2nd Removal step | 1st Removal Step Programing Rate | Beeswax Loss Rate a × xT | PE Residual Rate b x (1 − yT) | State After binder removal |
|---|---|---|---|---|---|
| 1 | 300 | 8° C./h. | 0.10 | 0.14 | bursting state |
| 2 | 300 | 4 | 0.10 | 0.14 | significantly cracked and blistered |
| 3 | 350 | 8 | 0.27 | 0.14 | 5 cracks |
| 4 | 350 | 4 | 0.27 | 0.14 | good |
| ⑤ | 375 | 8 | 0.43 | 0.13 | good |
| ⑥ | 400 | 8 | 0.64 | 0.13 | good |
| ⑦ | 425 | 8 | 0.81 | 0.12 | good |
| ⑧ | 450 | 8 | 0.85 | 0.10 | good |
| 9 | 475 | 8 | 0.86 | 0.02 | collapsed |

◯: Method of the invention
a = 0.86
b = 0.14

Example 7

8 types of samples were prepared by using alloy powder which was similar to that of Example 1 and changing the ratio of beeswax to low molecular weight polyethylene (PE) in the binder compositions (tests Nos. 10 to 17), to perform binder removal tests. Table 3 shows the results. The transition temperature from the first removal step to the second removal step was set at 450° C. The results of Table 3 show that the compositions according to the invention are excellent.

Example 8

Alloy powder similar to that of Example 3 were used and binder removal tests were performed by changing the types and compositions of the binders. Table 4 shows the results. The binder removal conditions were identical to those of Example 3. Good injection and binder removal were possible in the tests Nos. 18 to 20. In the test No. 21 employing n-paraffin, however, it was impossible to make a good injection molding unless the amount of n-paraffin was increased. In the test No. 22, on the other hand, distortion was caused during the binder removal. In the test No. 23 ofmixing beeswax and n-paraffin at 1/1, no deformation was

TABLE 3

Test Condition and Result

| Test No. | Binder Composition Beeswax/Low Molecular Weight PE | 1st Removal Step Programming rate | Beeswax Loss Rate $a \times x_{450}$ | PE Residual Rate $b \times (1 - y_{450})$ | bxyT (a × xT = 0.3) | State after binder removal |
|---|---|---|---|---|---|---|
| 10 | 6.5/0.5 | 10° C./h. | 0.92 | 0.05 | 0.005 | partially deformed |
| ⑪ | 6.0/1.0 | 10° C./h. | 0.85 | 0.10 | 0.008 | good |
| ⑫ | 5.0/2.0 | 10° C./h. | 0.71 | 0.20 | 0.018 | good |
| ⑬ | 4.0/3.0 | 10° C./h. | 0.57 | 0.30 | 0.032 | good |
| ⑭ | 3.0/4.0 | 10° C./h | 0.42 | 0.40 | 0.045 | good |
| ⑮ | 3.0/4.0 | 4° C./h. | 0.42 | 0.40 | 0.045 | good |
| 16 | 2.0/5.0 | 10° C./h. | 0.28 | 0.50 | not reaching a × xT = 0.3 | significantly cracked |
| 17 | 2.0/5.0 | 4° C./h. | 0.28 | 0.50 | not reaching a × xT = 0.3 | 2 cracks |

◯: Method of the Invention
Binder Composition: Rate with respect to 100% of Alloy Powder.

recognized during the binder removal although it was nec essary to add a slight amount of the binder.

TABLE 4

| Test No. | Wax Type | Wax Type and Result: Binder Composition Wax/ Low Molecular Weight PE | Injection | Binder Removal State |
|---|---|---|---|---|
| ⑱ | Carnauba Wax | 5.0/1.5 | possible | good |
| ⑲ | Beeswax | 5.0/1.5 | possible | good |
| ⑳ | Montan Wax | 5.0/1.5 | possible | good |
| 21 | n-Paraffin | 5.0/1.5 | impossible | — |
| 22 | n-Paraffin | 7.0/1.5 | possible | distorted |
| ㉓ | Beeswax + n-Paraffin | 3 + 3/1.5 | possible | good |

◯: Method of the Invention
Binder Composition: Rate with respect to 100% of Alloy Powder

Example 9

In a preparation method similar to the test No. 5 of Table 2, atmospheres for the first removal step and the second removal step were varied as shown at tests Nos. 24 to 30 in Table 5. The results of Table 5 show that the atmospheres of the invention are effective. It was impossible to perform the sintering steps on samples of the tests Nos. 26 and 29, since the same collapsed during the binder removal. Other samples were capable to be sintered.

TABLE 5

| Test No. | 1st Removal Step: up to 350° C. Gas | Flow Rate | Pressure | 2nd Removal Step: 350 to 700° C. Atmosphere | Flow Rate | Pressure | Result (Sintered Body) |
|---|---|---|---|---|---|---|---|
| ⑤ | Ar | 3l/min. | Atmospheric Pressure | Vacuum | | 0.5 Torr | good |
| ㉔ | Ar | 0.1l/min. | Atmospheric Pressure | Vacuum | | 0.5 Torr | good |
| ㉕ | $N_2$ | 3l/min. | Atmospheric Pressure | Vacuum | | 0.5 Torr | good |
| 26 | $N_2$ | 3l/min. | Atmospheric Pressure | $N_2$ | 3l/min. | Atmospheric Pressure | Collapsed (in debindering) |
| ㉗ | $N_2$ | 3l/min. | 600 Torr | Vacuum | | 0.5 Torr | good |
| 28 | Air | 3l/min. | Atmospheric Pressure | Vacuum | | 0.5 Torr | distorted, cracked |
| 29 | Ar | 3l/min. | Atmospheric Pressure | Ar | | 5 Torr | collapsed |
| 30 | $N_2$ | 3l/min. | Atmospheric Pressure | $H_2$ | 3l/min. | Atmospheric Pressure | low carbon abnormal phase caused |

◯: Method of the Invention

We claim:

1. A method for producing a cemented carbide or a cermet alloy, comprising the following steps:

(a) mixing and kneading a cemented carbide powder or cermet alloy powder with an organic binder to provide a powder binder mixture sufficiently viscous for injection molding, wherein said organic binder contains a first binder component having a first lower removal temperature and a second binder component having a second higher removal temperature, said first binder component comprising a first plurality i of first different types a1, a2, . . . , ai of binders, wherein a1, a2, . . . , ai represent ratios of respective first binder types of said low-temperature removal binder component, said second binder component comprising a second plurality j of second different types b1, b2, . . . , ji of binders, wherein b1, b2, . . . , bj represent ratios of respective second binder types of said high temperature removal binder component so that Σai+Σbj=1; wherein xT1, xT2, . . . , xTi represent loss rates of a single respective low-temperature removal binder type at a certain transition temperature T in inert gas atmospheric pressure heating loss tests (TG); wherein yT1, yT2, . . . , yTj represent loss rates of a single respective high temperature removal binder type at said certain transition temperature T in said inert gas atmospheric pressure heating loss tests (TG); and wherein compositions of respective binder types contained in said organic binder are selected to satisfy the following conditions:

$$\Sigma(i\ bj \times yTj)=0.05$$

and $$\Sigma bj \geqq 0.1$$

at said transition temperature T for which $$\Sigma(ai \times xTi)=0.3,$$

wherein said transition temperature T for transition from said first removal step to said second removal step is selected to satisfy the following conditions:

$$\Sigma(ai \times xTi)>0.3$$

and $$\Sigma\{bj \times (1-yTj)\}>0.05,$$

(b) injection molding said powder binder mixture to form a green compact having an injection molded configuration, (c) removing said organic binder from said compact in a first and in a second binder removal step, (d) said first binder removal step comprising heating said green compact in a furnace to said first lower removal temperature in an atmosphere of one of $N_2$ and Ar maintained at a sufficient flow rate within the range of 0.1 liter/min to 3 liter/min and at a pressure within the range of at least 600 Torr to atmospheric pressure of 760 Torr for preventing cracking and blistering of said green compact while removing at least a portion of said organic binder, (e) establishing said first lower removal temperature by raising a temperature in said furnace at a rate within the range of 4° C./hour to 10° C./hour until said first lower removal temperature is reached within the range of 350° C. to 450° C., (f) said second binder removal step comprising exposing said compact to a vacuum of 0.2 Torr to 0.5 Torr in said furnace and raising said first lower removal temperature to said second higher removal temperature at a rate of about 50° C./hour until 700° C. is reached as said second higher removal temperature for substantially removing any remainder of said organic binder, (g) maintaining said second removal temperature of 700° C. for about one hour, so that said first binder removal step continues into said second binder removal step, and whereby powder particles in said green compact are deoxidized for an initial bonding of said powder particles to each other to maintain a dimensional stability of said green compact prior to sintering, and (h) sintering said compact by evacuating said furnace to a vacuum of 0.05 Torr, raising said second higher removal temperature in said furnace at a rate of 200° C./hour to a sintering temperature within the range of 1350° C. to 1400° C., maintaining said sintering temperature for at least one hour, and cooling to room temperature.

2. The method of claim 1, wherein said first binder component having said first lower removal temperature includes wax comprising hydrophilic polar groups with a melting point of not more than 80° C.

* * * * *

UNITED STATES PATENT AND TRADEMARK OFFICE

CERTIFICATE OF CORRECTION

PATENT NO. : 5,603,071

DATED : Feb. 11, 1997

INVENTOR(S) : Kitagawa et al.

It is certified that error appears in the above-indentified patent and that said Letters Patent is hereby corrected as shown below:

Col. 2, line 37, replace "$\Sigma bj \geq 01$" by --$\Sigma bj \geq 0.1$--.

Col. 5, line 30, replace "therefore," by --Therefore,--.

Col. 9, Table 2, first heading, after "Second" insert --Removal--.

Col. 10, line 36, replace "ofmixing" by --of mixing--.

Col. 12, line 20, replace "$\Sigma(i\ bjxyTj)=0.05$" by --$\Sigma(bj \times yTj) \leq 0.05$--.

Signed and Sealed this

Fifth Day of August, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,603,071

DATED : Feb. 11, 1997

INVENTOR(S) : Kitagawa et al.

It is certified that error appears in the above-identified patent and that said Letters Patent is hereby corrected as shown below:

On the title page:

Item [63], the "Related U. S. Application Data" is corrected to read as follows:

--Continuation of Ser. No. 689,889, filed on May 10, 1991 as National Phase of PCT/JP90/01171 filed on September 12, 1990 and published as WO91/04119 on April 4, 1991, abandoned.--.

Col. 1, line 8, replace "PCT/JP90/01179" by --PCT/JP90/01171--.

line 9, replace "WO91/04245" by --WO91/04119--.

Signed and Sealed this

Second Day of December, 1997

Bruce Lehman

*Attest:*

BRUCE LEHMAN

*Attesting Officer*

*Commissioner of Patents and Trademarks*